United States Patent [19]

Spinner et al.

[11] Patent Number: 4,496,208

[45] Date of Patent: Jan. 29, 1985

[54] PLUG INNER CONDUCTOR FOR HF COAXIAL CABLES

[75] Inventors: Georg Spinner, Westerham; Franz X. Pitschi, Rottach-Egern, both of Fed. Rep. of Germany

[73] Assignee: Spinner GmbH Elektrotechnische Fabrik, Fed. Rep. of Germany

[21] Appl. No.: 370,920

[22] Filed: Apr. 22, 1982

[30] Foreign Application Priority Data

Apr. 24, 1981 [DE] Fed. Rep. of Germany ... 8112282[U]

[51] Int. Cl.[3] ..... H01R 17/18

[52] U.S. Cl. ..... 339/177 R; 339/267; 339/179

[58] Field of Search ..... 339/177 R, 177 E, 179, 339/267, 268

[56] References Cited

U.S. PATENT DOCUMENTS

| | | | |
|---|---|---|---|
| 2,801,396 | 7/1957 | Stegeman | 339/268 R |
| 2,955,275 | 10/1960 | Cobbett et al. | 339/268 R |
| 3,173,988 | 3/1965 | Martahus | 339/268 R |
| 3,317,882 | 5/1967 | Schumacher | 339/267 |
| 3,603,911 | 9/1971 | Erickson | 339/267 |

FOREIGN PATENT DOCUMENTS

| | | | |
|---|---|---|---|
| 103877 | 5/1938 | Australia | 339/267 |

*Primary Examiner*—Joseph H. McGlynn
*Assistant Examiner*—David L. Pirlot
*Attorney, Agent, or Firm*—Ostrolenk, Faber, Gerb & Soffen

[57] ABSTRACT

A plug inner conductor for connection to a tubular inner conductor of a coaxial cable is disclosed. The plug inner conductor includes a spreading sleeve having a slot formed therein which permits the effective diameter of the sleeve to be increased. A clamping cone is inserted through the spreading sleeve and has a shape which will cause the clamping cone to place a radially outward force on the spreading sleeve as the clamping cone is moved axially through the spreading sleeve. The clamping cone is coupled to an inner conductor sleeve in such a manner that the clamping cone is moved axially with respect to the inner conductor sleeve as the inner conductor sleeve is rotated.

9 Claims, 2 Drawing Figures

PLUG INNER CONDUCTOR FOR HF COAXIAL CABLES

BACKGROUND OF THE INVENTION

The present invention relates to a plug inner conductor for connection to tubular inner conductors HF coaxial cables.

It is known either to equip such plug inner conductors with a self-cutting thread which cuts a thread into he inner conductor tube of the coaxial cable or to provide both the plug inner conductor and the inner conductor tube with corresponding threads in advance. It is furthermore known to develop the plug inner conductor with radially outwardly resilient tongues which contact the tubular inner conductor of the coaxial cable on the inner surface thereof.

It is furthermore known to solder the inner plug conductor to the inner conductor tube of the coaxial cable. This technique is suitable, however, only in the case of cables having a sufficiently high heat resistance of the dielectric. It is furthermore known to produce the connection by crimping.

All of these known plug connections have certain disadvantages, as well as advantages.

The object of the present invention is to provide an inner conductor connection which assures a dependable mechanical connection and dependable contacting between a coaxial cable inner conductor and plug inner conductor and makes assembly being possible with the smallest possible expenditure of time.

This goal is obtained by providing a plug inner conductor, comprising:

- a spreading sleeve having a slot formed therein which permits the effective diameter of the sleeve to be increased;
- a clamping cone inserted through the spreading sleeve, the shape of the spreading sleeve and the clamping cone being such that the clamping cone places a radially outward force on the spreading sleeve, and thereby tends to increase the effective diameter of the spreading sleeve, as the clamping cone is moved axially through the spreading sleeve;
- an inner conductive sleeve; and
- means for coupling the inner conductor sleeve to the clamping cone in such a manner that the clamping cone is moved axially with respect to the inner conductor sleeve as the inner conductor sleeve is rotated.

As a result of the present invention, a dependable contact connection is obtained without any substantial deformation of the cable inner conductor. This connection can, if necessary, be opened again in a simple manner, which is important, for instance, upon the matching of cables having a given electrical length.

Furthermore, as a result of the axial clamping a dependable front contact is made possible between annular inner conductor contact ring surfaces.

BRIEF DESCRIPTION OF THE DRAWINGS

One embodiment of the invention will be described below with reference to the drawing, in which.

DETAILED DESCRIPTION OF THE INVENTION

Figure 1:
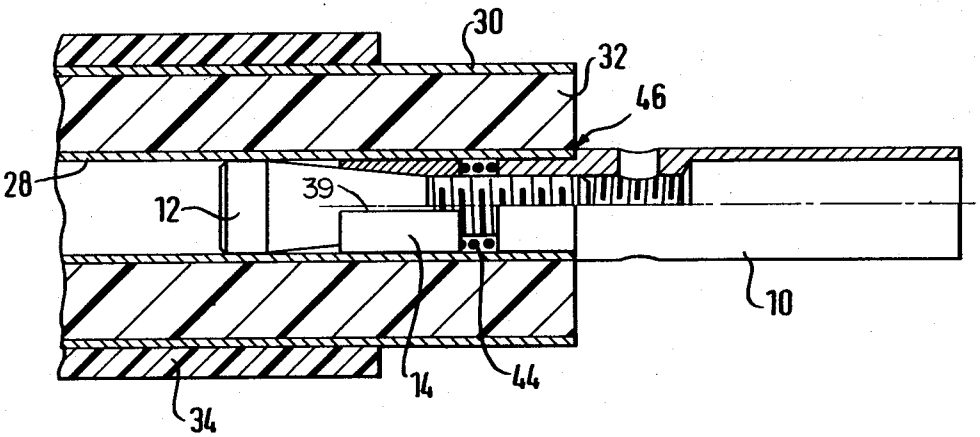
FIG. 1 is a sectional view through an inner conductor pin plug developed in accordance with the invention, inserted into the inner conductor tube of a coaxial cable, shown after final fixing.

The plug inner conductor 50 comprises an inner conductor sleeve 10, a clamping cone 12, and a spreading sleeve 14. The inner conductor sleeve 10 has an end contact surface 16 and an internal thread 18 into which the clamping cone 12 can be screwed by means of its external thread 22 provided on the cylindrical end section 20. The clamping cone 12 has a conical transition section 24 and a cylindrical end section 26, the latter corresponding in diameter to the inside diameter of the inner conductor tube 28 (FIG. 1) of a coaxial cable which also has an outer conductor 30 and a dielectric 32 located between outer and inner conductors 28,30 as well as a plastic protective jacket 34.

The spreading sleeve 14 is provided with a continuous longitudinal slot 39 which permits the diameter of sleeve 14 to be increased and it has an inner taper 36, the taper angle of which corresponds approximately to the taper angle of the conical transition section 24. Adjoining this inner taper 36 there is a cylindrical section 38. The spreading sleeve 14 is provided with a facet 40 at the end thereof facing the front end of the plug inner conductor 50. The outer surface of the spreading sleeve 40 may be roughened to increase the functional contact with conductor tube 28.

The contact connection is produced by placing the spreading sleeve 14 loosely on the clamping cone 12 and then screwing the latter into the inner conductor sleeve 10 without spreading the sleeve 14. The plug inner conductor 50 is then introduced into the inner conductor tube 28 of the coaxial cable in the manner which can be noted from FIG. 1 and the inner conductor sleeve 10 is rotated the clamping cone 12 remaining fixed against rotation in the tube 28 by frictional attachment to the spreading sleeve 14 and being pulled in axial direction to the right as viewed in FIG. 1. Due to the frictional force, the inner conductor tube 28 is also pulled towards the right against the end contact flange 16 of the inner conductor sleeve 10 so that an end contact pressure is produced at this place. At the same time, due to the axial displacement of the clamping cone 12 over the conical transition section 24 the spreading sleeve 14 is, on the one hand, widened, it being possibly displaced to the right to such an extent that it comes against the end annular surface 42 of the inner conductor sleeve 10. As a result of the axial relative movement between the clamping cone 12 and the spreading sleeve 14 a radially outwardly acting spreading pressure which assures the fixing of the plug inner conductor in the inner conductor 50 tube 28 of the cable.

The faceted edge 40 of the sleeve 14 facilitates insertion of the plug inner conductor 50 into the inner conductor tube 28. A similar faceted edge may be formed on the front end section 26 of clamping cone 12. The arrangement of the tapers and the dimensioning of the spreading sleeve 14 are such that in the completely assembled condition the spreading sleeve 14 produces a dependable self-locking but disconnectable attachment due to radially outward force exerted on the inner conductor tube 28.

Figure 2:
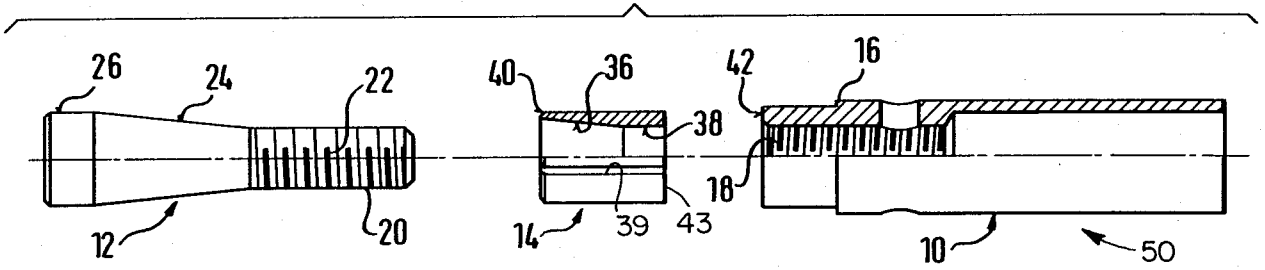
FIG. 2 is an exploded view, partially in section, of the individual parts of the plug inner conductor according to the invention.

In order to open the connection the thread attachment between inner conductor sleeve 10 and clamping cone 12 is loosened and the clamping cone 12 is pushed out of the spreading sleeve 14 by a slight knock in axial direction The right-hand or rear end surface, seen in FIG. 2, of the clamping cone 12 or of its cylindrical section 20 can have an recess for the insertion of a screwdriver or a wrench socket, for instance an internal hex socket, in order to be enabled, if necessary, the introduction of a tool to loosen the connection between inner conductor sleeve 10 and cone 12.

As can be noted from FIG. 1, a compression coil spring 44 can be placed over the cylindrical section 20 of the clamping cone 12, the spring 4 resting against the end annular surface 42 (FIG. 2) of the inner conductor sleeve 10 and the opposite end annular surface 43 of the clamping sleeve 14 and producing a certain initial tension.

We claim:

1. A plug inner conductor for connection to a tubular inner conductor of a coaxial cable, said plug inner conductor comprising:

a spreading sleeve having a slot formed therein which permits the effective diameter of said sleeve to be increased;

a clamping cone inserted through said spreading sleeve, the shape of said spreading sleeve and said clamping cone being such that said clamping cone places a radially outward force on said spreading sleeve, and thereby tends to increase the effective diameter of said spreading sleeve, as said clamping cone is moved axially through said spreading sleeve;

an inner conductor sleeve;

means for coupling said inner conductor sleeve to said clamping cone in such a manner that said clamping cone is moved axially with respect to said inner conductor sleeve as said inner conductor sleeve is rotated with respect to said clamping cone; and a compression spring located between confronting radial surfaces of said inner conductor sleeve and said spreading cone.

2. The plug inner conductor of claim 1, wherein said spreading sleeve has an inner taper which mates with an outer taper formed in said clamping cone.

3. The plug inner conductor of claim 1, wherein said spreading sleeve has a faceted surface formed on a front edge thereof to facilitate insertion of said clamping cone into said coaxial cable.

4. The plug inner conductor of claim 1, further including a front contact surface formed on said inner conductor sleeve which limits the distance said inner conductor sleeve may be inserted into said coaxial cable.

5. The plug inner conductor of claim 1, wherein said spreading sleeve has a roughened outer surface.

6. The plug inner conductor of claim 1, further including a screwdriver recess formed in the rear end of said clamping cone.

7. The plug inner conductor of claim 1, further including a wrench socket formed in the rear end of said clamping cone.

8. The plug inner conductor of claim 1, wherein said coupling means comprises internal and external threads formed on mating portions of said inner conductor sleeve and said clamping cone.

9. The plug inner conductor of claim 8, wherein said clamping cone has a faceted surface formed on a front edge thereof to facilitate insertion of said clamping cone into said coaxial cable.

* * * * *